US006454426B1

(12) United States Patent
Altman

(10) Patent No.: US 6,454,426 B1
(45) Date of Patent: Sep. 24, 2002

(54) MINIATURE FLASHLIGHT DEVICE HAVING HOUSING WITH OUTER AND INNER ENCLOSURES

(75) Inventor: Peter Altman, Austin, TX (US)

(73) Assignee: Lumatec Industries, Inc., Austin, TX (US)

( * ) Notice: Subject to any disclaimer, the term of this patent is extended or adjusted under 35 U.S.C. 154(b) by 0 days.

(21) Appl. No.: 09/757,162

(22) Filed: Jan. 9, 2001

(51) Int. Cl.[7] ..... F21V 33/00
(52) U.S. Cl. ..... 362/116; 362/189; 362/201
(58) Field of Search ..... 362/116, 189, 362/201

(56) References Cited

U.S. PATENT DOCUMENTS

| | | | | |
|---|---|---|---|---|
| 3,796,869 A | | 3/1974 | Stone | 240/2.25 |
| 5,158,356 A | | 10/1992 | Guthrie | 362/188 |
| 5,642,931 A | * | 7/1997 | Gappelberg | 362/186 |
| 5,893,631 A | | 4/1999 | Padden | 362/201 |
| 6,006,562 A | * | 12/1999 | Wolter | 70/456 |
| 6,079,845 A | * | 6/2000 | Kreider | 362/116 |
| 6,190,018 B1 | * | 2/2001 | Parsons et al. | 362/116 |
| 2001/0005316 A1 | * | 6/2001 | Galli | 362/201 |

FOREIGN PATENT DOCUMENTS

| | | | |
|---|---|---|---|
| FR | 1443787 | 5/1966 | 362/200 |

* cited by examiner

*Primary Examiner*—Sandra O'Shea
*Assistant Examiner*—Ali Alavi
(74) *Attorney, Agent, or Firm*—Flanagan & Flanagan; John R. Flanagan

(57) ABSTRACT

A miniature flashlight device includes a housing having a base and a cover adapted to interfit with the base so as to form therewith an outer enclosure for receiving an electric bulb and an inner enclosure within the outer enclosure for receiving a button-cell battery. The cover has a flexible portion overlying the inner enclosure and capable of being depressed by a user from an outer relaxed configuration to an inner flexed configuration in which the flexible portion of the cover is deflected toward the inner enclosure and capable of returning to the outer relaxed configuration upon release by the user.

12 Claims, 5 Drawing Sheets

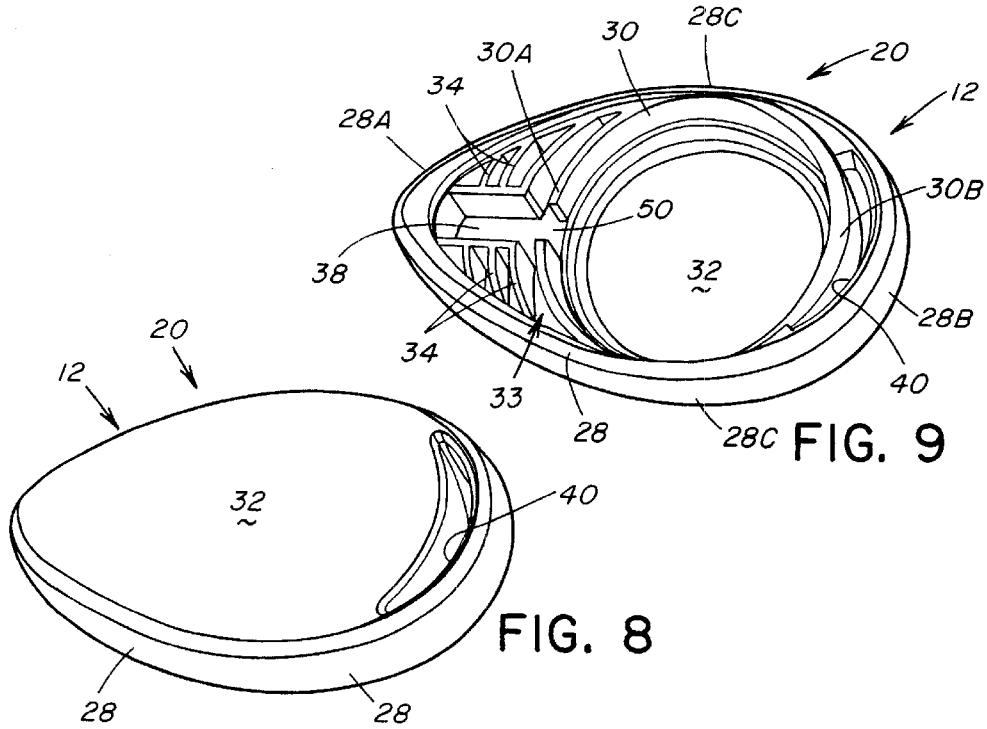
FIG. 9
FIG. 8
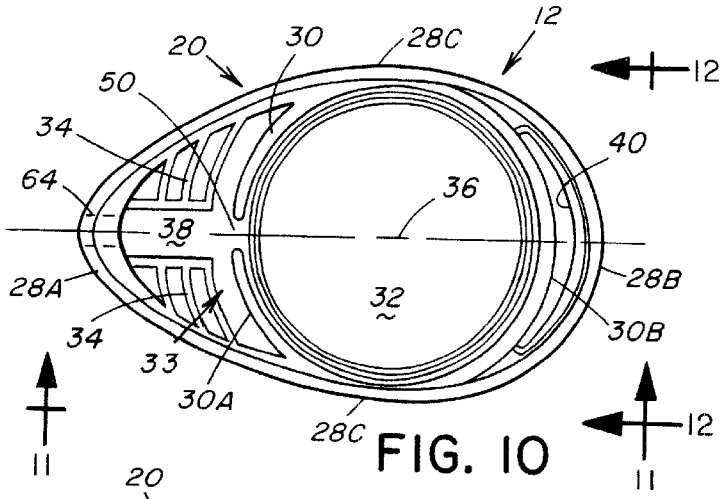
FIG. 10
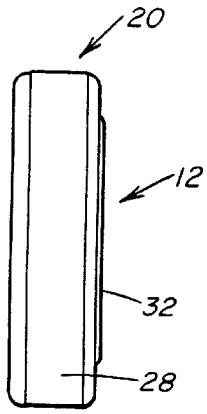
FIG. 12
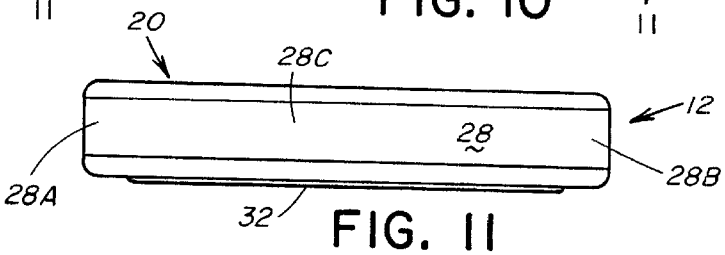
FIG. 11

MINIATURE FLASHLIGHT DEVICE HAVING HOUSING WITH OUTER AND INNER ENCLOSURES

BACKGROUND OF THE INVENTION

1. Field of the Invention

The present invention generally relates to portable lighting devices and, more particularly, is concerned with a miniature flashlight device having a housing with outer and inner enclosures.

2. Description of the Prior Art

Miniature portable flashlight devices which can be stored in a pocket or attached to a key chain are known in the prior art. Examples of such devices are disclosed in U.S. Pat. No. 5,158,356 to Guthrie, U.S. Pat. No. 5,893,631 to Padden and French Pat. No. 1,443,787 to Teisseire. Some common components of these devices include a disk-shaped battery, also known as a button-cell battery, an electric lamp or bulb having a pair of conductive portions or lead elements extending therefrom and positioned to electrically contact spaced portions of the battery having respective positive and negative polarities, and an actuating element being movable for closing and opening an electrical circuit between the battery and bulb.

While these devices are of various configurations and constructions, they all must reliably position the battery and the conductive portions or lead elements of the bulb relative to the spaced portions of the battery in order to ensure the closing and opening of the electrical circuit when desired. In the case of each of these devices, either the bulb or battery is moved relative to one another along with movement of the actuating element or one conductive lead element in order to close and open the electrical circuit between the battery and bulb. The more components that must be made to move relative to others the more likely it is that some of the components over time will wear and/or loosen up in a manner detrimental to their reliability.

Consequently, a need still remains for innovation in the construction of miniature flashlight devices that will avoid or eliminate the problems of the prior art without introducing new problems in place thereof.

SUMMARY OF THE INVENTION

The present invention provides a miniature flashlight device with a housing having outer and inner enclosures designed to satisfy the aforementioned needs.

Accordingly, the present invention is directed to a housing for a miniature flashlight device which comprises: (a) a base; and (b) a cover adapted to interfit with the base so as to form therewith an outer enclosure for receiving an electric bulb and an inner enclosure within the outer enclosure for receiving a button-cell battery. The cover has a flexible portion overlying the inner enclosure and capable of being depressed by a user from an outer relaxed configuration to an inner flexed configuration in which the flexible portion is deflected toward the inner enclosure and capable of returning to the outer relaxed configuration upon release by the user.

The present invention also is directed to a housing for a miniature flashlight device which comprises: (a) a base having an outer sidewall and an inner sidewall disposed within the outer sidewall and merging therewith at opposite side portions of the outer sidewall, the outer and inner sidewalls each having respective top and bottom portions and forward and rearward portions; and (b) a cover having an upper panel and a lower sidewall attached to and extending downwardly from a lower surface of the upper panel, the upper panel being adapted to overlie and close the top portion of the inner sidewall and the top portion of the outer sidewall at the forward portion thereof so as to form therewith an outer enclosure for receiving an electric bulb, the lower sidewall being adapted to fit within the inner sidewall of the base so as to form therewith an inner enclosure within the outer enclosure for receiving a button-cell battery. The upper panel of the cover having a flexible portion overlying the inner enclosure.

The present invention further is directed to a miniature flashlight device which comprises: (a) a housing having a base and a cover adapted to interfit with the base so as to form therewith an outer enclosure and an inner enclosure disposed within the outer enclosure, the cover capable of being depressed by a user from an outer relaxed configuration to an inner flexed configuration and capable of returning to the outer relaxed configuration upon release by the user; (b) a button-cell battery disposed within the inner enclosure of the housing and having first and second spaced apart portions of respective positive and negative polarities; (c) a dome switch disposed within the inner enclosure of the housing between the cover and the first portion of the battery and in response to application of force thereto capable of being deformed from an unflexed configuration to a flexed configuration and in response to release of force therefrom capable of returning to the unflexed configuration; and (d) an electric bulb disposed within the outer enclosure of the housing and having a pair of conductive lead elements extending therefrom into the inner enclosure of the housing, one of the lead elements having a portion disposed in electrical contact with the second portion of the battery and the other of the lead elements having a portion disposed between the cover and the dome switch such that the battery, dome switch and lead elements of the electric bulb will normally form an open electrical circuit with the cover in the outer relaxed configuration and the dome switch in the unflexed configuration whereas by depressing the cover to the inner flexed configuration the cover will force the dome switch into the flexed configuration and into electrical contact with the first portion of the battery so as to establish an electrical connection between the portion of the other lead element and the first portion of the battery via the dome switch and thereby form a closed electrical circuit between the battery, dome switch and lead elements of the electric bulb.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 8 is a bottom perspective view of a base of the housing of the device of FIG. 2 on a reduced scale.

FIG. 9 is a top perspective view of the base.

FIG. 10 is a top plan view of the base.

FIG. 11 is a side elevational view of the base as seen along line 11—11 of FIG. 10.

FIG. 12 is an end elevational view of the base as seen along line 12—12 of FIG. 10.

DETAILED DESCRIPTION OF THE INVENTION

Figure 1:
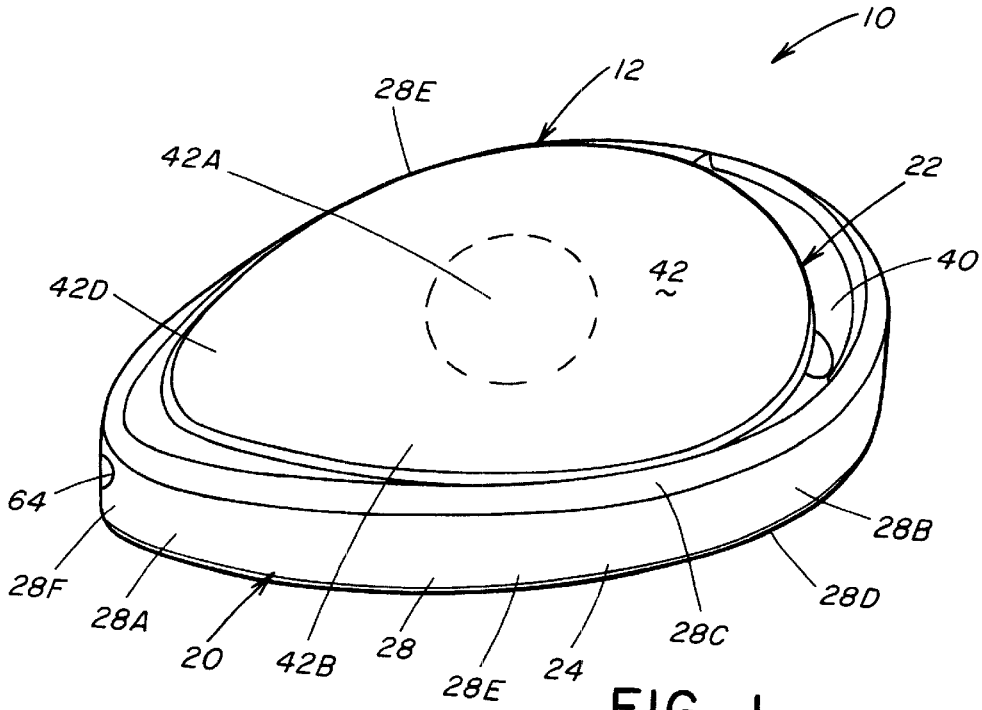
FIG. 1 is an assembled top perspective view of a miniature flashlight device of the present invention having a housing with outer and inner enclosures.

Referring to the drawings and particularly to FIGS. 1 to 7, there is illustrated a miniature flashlight device of the present invention, generally designated 10. The device 10 basically includes a housing 12, a button-cell battery 14, a dome switch 16 and an electric lamp or bulb 18. The housing 12 includes a body or base 20 and a cover 22 adapted to interfit with the base 20 so as to form therewith an outer enclosure 24 for receiving the electric bulb 18 and an inner enclosure 26 disposed within the outer enclosure 24 for receiving the button-cell battery 14.

Referring to FIGS. 1 to 12, the base 20 of the housing 12 includes an outer sidewall 28, an inner sidewall 30 and a bottom wall 32. Each of the outer and inner sidewalls 28, 30 has respective forward and rearward portions 28A, 30A and 28B, 30B and top and bottom portions 28C, 30C and 28D, 30D. The outer sidewall 28 has a generally egg-shaped configuration, as viewed from above or below, the base 20, although other configurations are possible. The inner sidewall 30 has a generally circular configuration as viewed from above or below the base 20, although, here too, other configurations are possible. The inner sidewall 30 is disposed within the outer sidewall 28 and merges therewith at opposite side portions 28E of the outer sidewall 28 located between and interconnecting the forward and rearward portions 28A, 28B thereof. The outer and inner sidewalls 28, 30 of the base 20 are spaced apart from one another at their respective forward portions 28A, 30A so as to define a cavity 33 in the outer enclosure 24 between the respective forward portions 28A, 30A of the outer and inner sidewalls 28, 30. The base 20 also includes a pair of honeycomb like structures 34 provided in the cavity 33 of the outer enclosure 24 between the forward portions 28A, 30A of the outer and inner sidewalls 28, 30. The structures 34 are laterally spaced from one another in opposite directions from a longitudinal centerline 36 of the base 20 and rigidly attached to the bottom wall 32 and opposite segments of the front portion 28A of the outer sidewall 28 of the base 20 as to reinforce the base 20 and define a channel 38 between the structures 34 which receives the electric bulb 18 therein. The outer and inner sidewalls 28, 30 of the base 20 further are spaced apart from one another at their rearward portions 28B, 30B so as to define an arcuate-shaped passage. 40 through the housing 12 for receiving a keychain (not shown) or the like through the passage 40. The bottom wall 32 of the base 20 is rigidly attached to and covers all of the bottom portion 30D of the inner sidewall 30 and the bottom portion 28D of the outer sidewall 28 at the forward portion 28A thereof so as to close the bottom side of the base 20 except for the passage 40. The base 20 can be manufactured by any suitable well-known fabrication technique, such as by being injection molded as a one-piece unit from a suitable plastic material.

Figure 2:
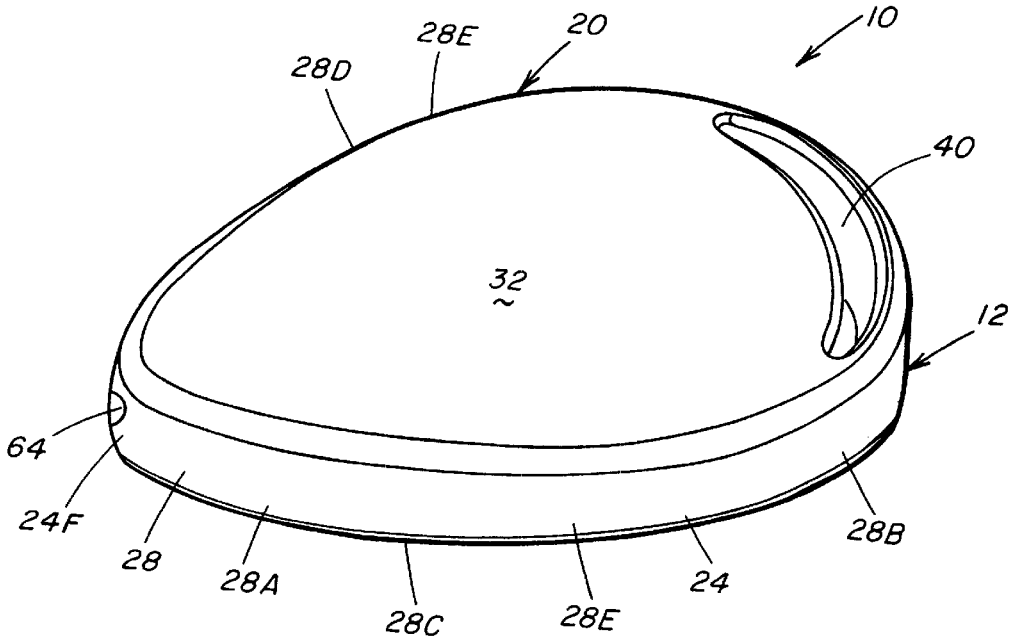
FIG. 2 is an assembled bottom perspective view of the device.
Figure 4:
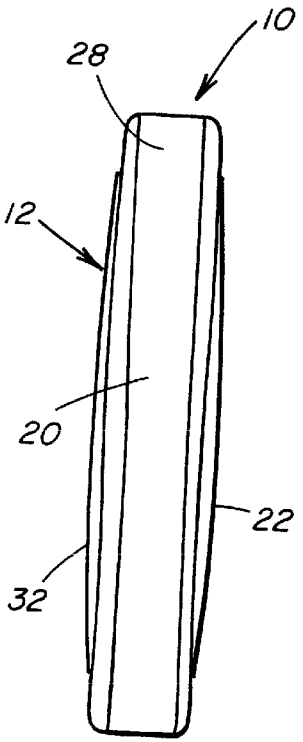
FIG. 4 is a side elevational view of the device as seen along line 4—4 of FIG. 3.
Figure 3:
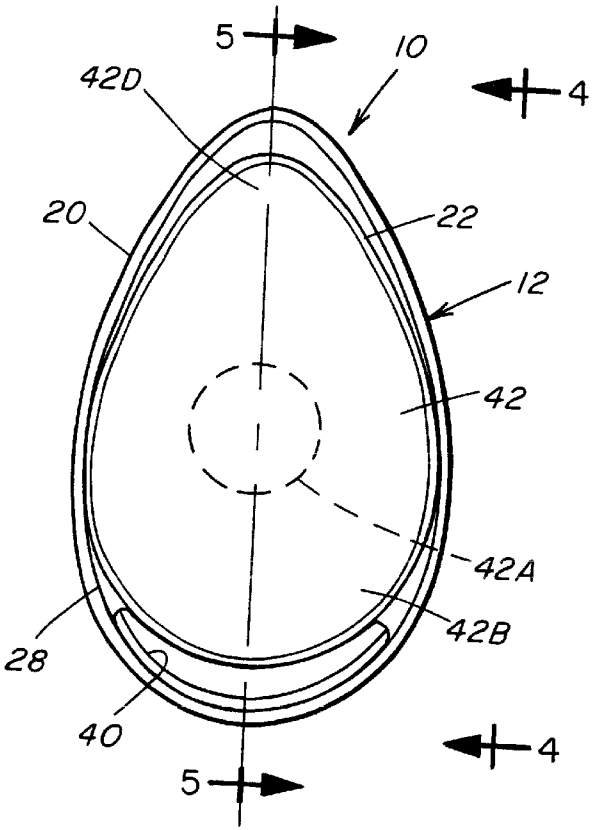
FIG. 3 is an assembled top plan view of the device of FIG. 1 on a reduced scale.
Figure 15:
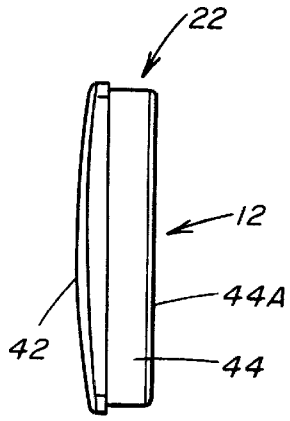
FIG. 15 is an end elevational view of the cover as seen along line 15—15 of FIG. 13.
Figure 14:
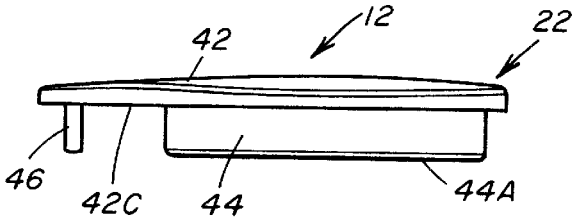
FIG. 14 is a side elevational view of the cover as seen along line 14—14 of FIG. 13.
Figure 18:
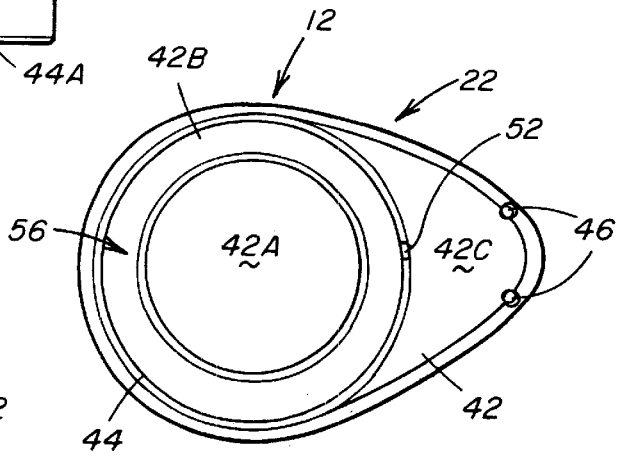
FIG. 18 is a bottom plan view of the cover.
Figure 16:
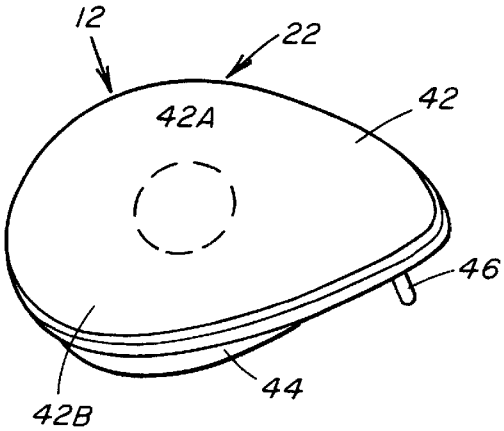
FIG. 16 is a top perspective view of the cover rotated 180° from the position of the cover in FIG. 6.
Figure 17:
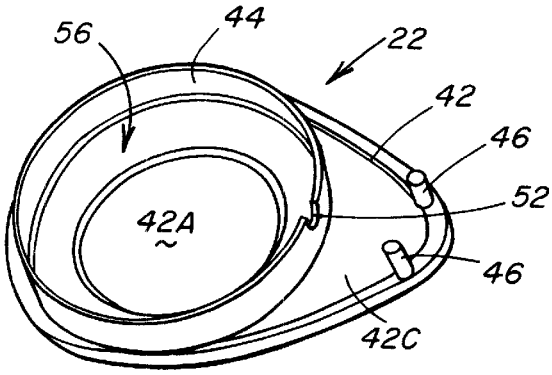
FIG. 17 is a bottom perspective view of the cover.

Referring to FIGS. 1 to 7 and 13 to 18, the cover 22 of the housing 12 has an upper panel 42 and a lower sidewall 44. The upper panel 42 is generally flat and egg-shaped in configuration similar to the configuration of the outer sidewall 28 of the base 20. The upper panel 42 is adapted to overlie and close the top portion 30C of the inner sidewall 30 of the base 20 and the top portion 28C of the outer sidewall 28 of the base 20 at the forward portion 28A thereof. The upper panel 42 has a circular portion 42A which is generally centrally located and is flexible due to it being reduced in thickness compared to the remaining peripheral portion 42B of the upper panel 42 surrounding the flexible circular portion 42A. The lower sidewall 44 has a generally circular configuration and is rigidly attached to a lower surface 42C of the upper panel 42 and extends about and downwardly from the flexible circular portion 42A thereof. The lower sidewall 44 is open at its lower end 44A and is slightly smaller in diameter than the inner sidewall 30 of the base 20, adapting the lower sidewall 44 of the cover 22 to snugly interfit within the inner sidewall 30 of the base 20 and form the inner enclosure 26 therewith when the cover 22 is mounted upon the top side of the base 20 as seen in FIGS. 2 and 3. The cover 22 has a pair of pins 46 attached to and extending downwardly from the peripheral portion 42B of the top panel 42 at opposing locations on a forward portion 42D thereof. The pins 46 contact and seat upon a ledge 48 formed along the interior cavity 33 of the forward portion 28A of the outer sidewall 28 of the base 20 when the cover 22 is mounted upon the base 20. The cover 22 can be manufactured by any suitable well-known fabrication technique, such as by being injection molded as a one-piece unit from a suitable plastic material, like the base 20. The cover 22 can be attached upon the top side of the base 20 in any suitable manner, such as by being adhesively attached or ultrasonically welded thereon. The flexible central portion 42A of the upper panel 42 of the cover 22 is capable of being depressed by a user from an outer relaxed configuration, as seen in solid line form in FIG. 15 to an inner flexed configuration, as seen in broken line form in FIG. 15. The central portion 42A of the upper panel 42 of the cover 22 is capable of returning to the outer relaxed configuration upon release by the user. The inner sidewall 30 of the base 20 and the lower sidewall 44 of the cover 22 have slots 50, 52 defined at corresponding front portions thereof such that an opening 54 is formed through the interfitted sidewalls 30, 44 between outer and inner enclosures 24, 26.

Figure 5:
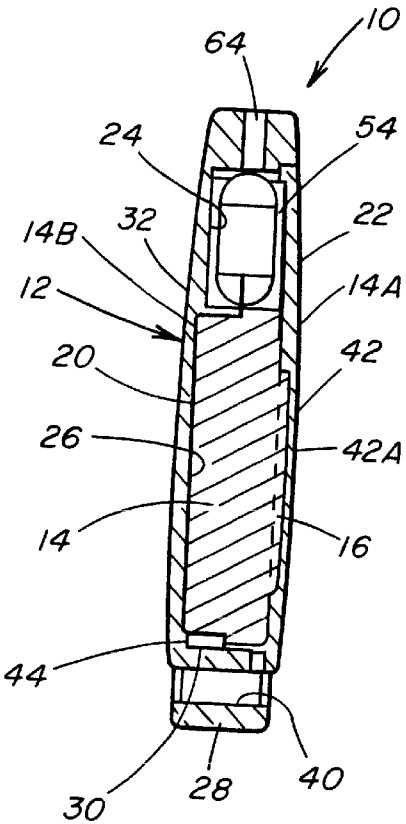
FIG. 5 is a longitudinal sectional view of the device taken along line 5—5 of FIG. 3.
Figure 6:
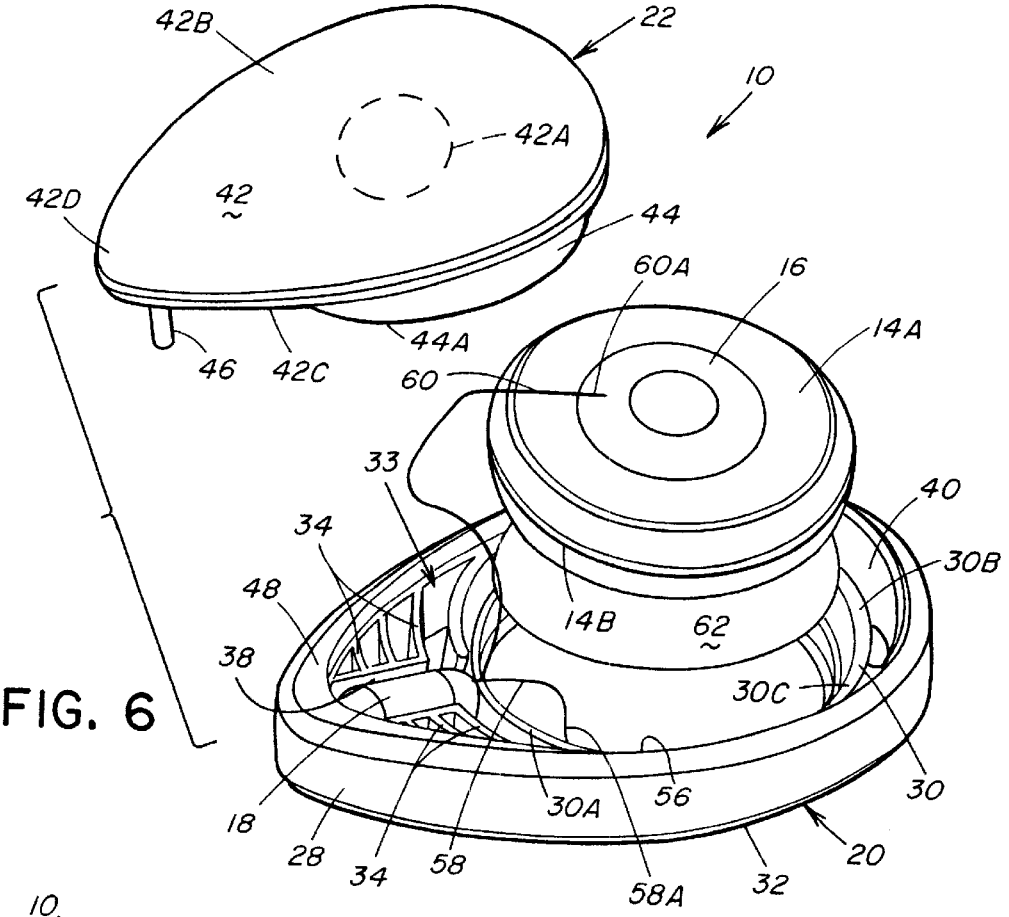
FIG. 6 is an exploded perspective view of the device of FIG. 1.
Figure 7:
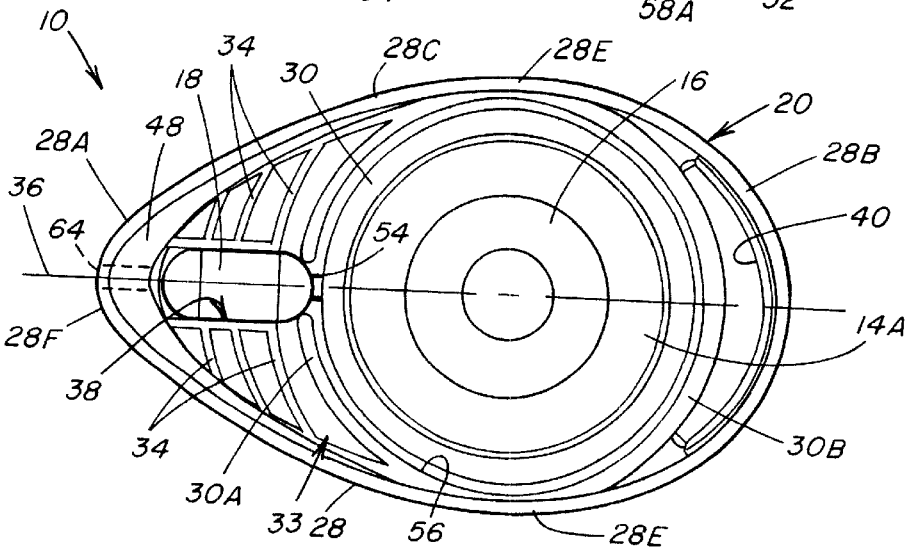
FIG. 7 is a top plan view of the device with a cover of the housing thereof removed.
Figure 13:
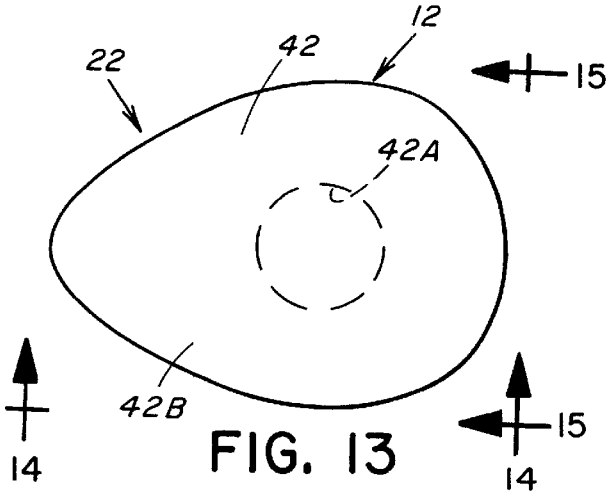
FIG. 13 is a top plan view of the cover of the housing of the device on a reduced scale from that of FIG. 6.

Referring to FIGS. 5 to 7, the button-cell battery 14 is snugly disposed within a chamber 56 defined by the inner enclosure 26 of the housing 12. The battery 14 has first and second spaced apart portions 14A, 14B of respective positive and negative polarities. The dome switch 16 also is disposed within the chamber 56 of the inner enclosure 26 of the housing 12 between the flexible portion 42A of the upper panel 42 of the cover 22 of the housing 12 and the first portion 14A of the battery 14. In response to the external application of suitable force to the cover 22, the flexible portion 42A of the cover 22 and the dome switch 16 therewith are deformed from respective unflexed configurations, as seen in solid line form in FIG. 5, to a flexed configuration, as seen in dashed line form in FIG. 3. In response to release of the external force therefrom, the flexible portion 42A of the upper panel 42 of the cover 22 and the dome switch 16 therewith return to their respective unflexed configurations. The electric bulb 18 is disposed and positioned within and by the channel 38 of the outer enclosure 24 of the housing 12 so as to adapt a pair of conductive lead elements 58, 60 of the bulb 18 to extend from the channel 38 through the opening 54 into the chamber 56 of the inner enclosure 26 of the housing 12. One lead element 58 of the pair thereof has a portion 58A disposed in electrical contact with the second portion 14B of the battery 14 and the other lead element 60 of the pair thereof has a portion 60A disposed between the flexible portion 42A of the cover 22 and the top of the dome switch 16 such that the battery 14, dome switch 16 and lead elements 58, 60 of the electric bulb 18 will normally form a non-conducting open electrical circuit with the flexible portion 42A of the cover 22 in the outer relaxed configuration and the dome switch 16 in the unflexed configuration whereas by depressing the flexible portion 42A of the cover 22 to the inner flexed configuration the cover 22 will force the dome switch 16 into the flexed configuration and into electrical contact with the first portion 14A of the battery 14 so as to establish an electrical connection between the portion 60A of the other lead element 60 and the first portion 14A of the battery 14 via the dome switch 16 and thereby form a conducting closed electrical circuit between the battery 14, dome switch 16 and lead elements 58, 60 of the electric bulb 18.

Furthermore, at least one and preferably both of the base 20 and cover 22 of the housing 12 are made of a translucent material which permits light to be transmitted therethrough from the electric bulb 18 such that large areas of the device 10 are illuminated by the lamp 18 when the electrical circuit is closed. optionally, as seen in FIG. 6, an opaque insert disc 62 can disposed in the chamber 56 of the inner enclosure 26 between the bottom wall 32 of the base 20 and the battery 14 so as to hide the bottom of the battery 14 such that it cannot be seen or viewed through the adjacent portion of the bottom wall 32 of the base 20. A front end 28f of the outer sidewall 28 of the base 20 has a bore 64 formed therethrough in alignment with the channel 38 and the longitudinal axis 26 of the base 20 to permit the projection of a beam of light from the front end 28f of the housing 12. optionally, the bore 64 can be omitted and instead the translucent nature of the housing 12 will provide the necessary illumination.

It is thought that the present invention and many of its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A housing for a miniature flashlight device, comprising:

(a) a base including an outer sidewall and an inner sidewall of circular configuration being disposed within said outer sidewall and merging therewith at opposite side portions of said outer sidewall, said outer and inner sidewalls having respective forward portions being spaced apart so as to define a cavity therebetween for receiving an electric bulb in said base, said outer and inner sidewalls also having respective rearward portions and opposite top and bottom portions, said top portions of said outer and inner sidewalls being open, said base also including a bottom wall rigidly attached to and covering all of said bottom portion of said inner sidewall and rigidly attached to and covering at least most of said bottom portion of said outer sidewall including said forward portion thereof; and (b) a cover including an upper panel adapted to overlie and close all of said top portion of said inner sidewall of said base and to overlie and close at least most of said top portion of said outer sidewall of said base including said forward portion thereof so as to form an outer enclosure enclosing said cavity that receives the electric bulb, said cover also including a lower sidewall of circular configuration rigidly attached to and extending downwardly from said upper panel and open at a lower end and adapted to interfit within said circular inner sidewall of said base so as to form therewith and with said bottom wall of said base and said upper panel of said cover an inner enclosure within said outer enclosure for receiving a button-cell battery, said upper panel of said cover having a flexible portion overlying said inner enclosure and capable of being depressed by a user from an outer relaxed configuration to an inner flexed configuration in which said flexible portion is deflected toward said inner enclosure and capable of returning to said outer relaxed configuration upon release by the user.

2. The housing of claim 1 wherein at least one of said base and cover are made of a translucent material.

3. The housing of claim 1 wherein said base further includes a pair of honeycomb structures provided in said outer enclosure in said cavity defined between said respective forward portions of said outer and inner sidewalls and spaced apart from one another and rigidly attached to said outer sidewall and bottom wall of said base to as to reinforce said base and define a channel between said honeycomb structures for positioning the electric bulb therein and adapting a pair of conductive leads of the electric bulb to be extended from said channel into said inner enclosure.

4. The housing of claim 1 wherein said outer and inner sidewalls of said base are spaced apart at said rearward portions thereof so as to define a passage therebetween through said base not closed by said upper panel of said cover nor said bottom wall of said base for receiving a keychain through said base.

5. A housing for a miniature flashlight device, comprising:

(a) a base including an outer sidewall and an inner sidewall of circular configuration disposed within said outer sidewall and merging therewith at opposite side portions of said outer sidewall, said outer and inner sidewalls having respective forward portions being spaced apart so as to define a cavity therebetween for receiving an electric bulb in said base, said outer and inner sidewalls also having respective rearward portions and opposite top and bottom portions, said top portions of said outer and inner sidewalls being open, said base also including a bottom wall rigidly attached to and covering all of said bottom portion of said inner sidewall and rigidly attached to and covering at least most of said bottom portion of said outer sidewall including said forward portion thereof, said base further including a pair of honeycomb structures provided in said outer enclosure in said cavity defined between said respective forward portions of said outer and inner sidewalls and spaced apart from one another and rigidly attached to said outer sidewall and bottom wall of said base to as to reinforce said base and define a channel between said honeycomb structures for positioning the electric bulb therein and adapting a pair of conductive leads of the electric bulb to be extended from said channel into said inner enclosure; and (b) a cover including an upper panel being adapted to overlie and close all of said top portion of said inner sidewall of said base and to overlie and close at least most of said top portion of said outer sidewall of said base including said forward portion thereof so as to form an outer enclosure enclosing said cavity that receives the electric bulb, said cover also including a lower sidewall of circular configuration rigidly attached to and extending downwardly from said upper panel and open at a lower end and adapted to interfit within said circular inner sidewall of said base so as to form therewith and with said bottom wall of said base and said upper panel of said cover an inner enclosure within said outer enclosure for receiving a button-cell battery, said upper panel of said cover having a flexible portion overlying said inner enclosure and capable of being depressed by a user from an outer relaxed configuration to an inner flexed configuration in which said flexible portion is deflected toward said inner enclosure and capable of returning to said outer relaxed configuration upon release by the user.

6. The housing of claim 5 wherein at least one of said base and cover are made of a translucent material.

7. The housing of claim 5 wherein said rearward portion of said outer sidewall of said base extends rearwardly from said opposite side portions of said outer sidewall and is spaced apart from said rearward portion of said inner sidewall of said base so as to define a passage therebetween through said base not closed by said upper panel of said cover nor said bottom wall of said base for receiving a keychain through said base.

8. A miniature flashlight device, comprising:

(a) a housing including (i) a base having an outer sidewall and an inner sidewall of circular configuration disposed within said outer sidewall and merging therewith at opposite side portions of said outer sidewall, said outer and inner sidewalls having respective forward portions being spaced apart so as to define a cavity therebetween for receiving an electric bulb in said base, said outer and inner sidewalls also having respective rearward portions and opposite top and bottom portions, said top portions of said outer and inner sidewalls being open, said base also including a bottom wall rigidly attached to and covering all of said bottom portion of said inner sidewall and rigidly attached to and covering at least most of said bottom portion of said outer sidewall including said forward portion thereof, and (ii) a cover including an upper panel adapted to overlie and close all of said top portion of said inner sidewall of said base and to overlie and close at least most of said top portion of said outer sidewall of said base including said forward portion thereof so as to form an outer enclosure enclosing said cavity that receives the electric bulb, said cover also including a lower sidewall of circular configuration rigidly attached to and extending downwardly from said upper panel and open at a lower end and adapted to interfit within said circular inner sidewall of said base so as to form therewith and with said bottom wall of said base and said upper panel of said cover an inner enclosure disposed within said outer enclosure for receiving a button-cell battery, said upper panel of said cover having a flexible portion overlying said inner enclosure and capable of being depressed by a user from an outer relaxed configuration to an inner flexed configuration in which said flexible portion is deflected toward said inner enclosure and capable of returning to said outer relaxed configuration upon release by the user;

(b) a button-cell battery disposed within said inner enclosure of said housing and having first and second spaced apart portions of respective positive and negative polarities;

(c) a dome switch disposed within said inner enclosure of said housing between said cover and said f first portion of said battery and in response to application of force thereto capable of being deformed from an unflexed configuration to a flexed configuration and in response to release of force therefrom capable of returning to said unflexed configuration; and (d) an electric bulb disposed within said cavity of said outer enclosure of said housing and having a pair of conductive lead elements extending therefrom into said inner enclosure of said housing, one of said lead elements having a portion disposed in electrical contact with said second portion of said battery and the other of said lead elements having a portion disposed between said cover and said dome switch such that said battery, dome switch and lead elements of said electric bulb will normally form an open electrical circuit with said cover in said outer relaxed configuration and said dome switch in said unflexed configuration whereas by depressing said cover to said inner flexed configuration said cover will force said dome switch into said flexed configuration and into electrical contact with said first portion of said battery so as to establish an electrical connection between said portion of said other lead element and said first portion of said battery via said dome switch and thereby form a closed electrical circuit between said battery, dome switch and lead elements of said electric bulb.

9. The device of claim 8 wherein at least one of said base and cover of said housing are made of a translucent material.

10. The housing of claim 8 wherein said base further has a pair of honeycomb structures provided in said outer enclosure in said cavity defined between said respective forward portions of said outer and inner sidewalls and spaced apart from one another and rigidly attached to said outer sidewall and bottom wall of said base to as to reinforce said base and define a channel between said honeycomb structures for positioning the electric bulb therein and adapting said conductive leads of said electric bulb to be extended from said channel into said inner enclosure.

11. The housing of claim 8 wherein said outer and inner sidewalls of said base are spaced apart at said rearward portions thereof so as to define a passage therebetween through said base not closed by said upper panel of said cover nor said bottom wall of said base for receiving a keychain through said base.

12. The device of claim 8 wherein an insert disc is disposed in said inner enclosure between said bottom wall and said battery.

* * * * *